US006158223A

United States Patent [19]

Mandai et al.

[11] Patent Number: 6,158,223

[45] Date of Patent: Dec. 12, 2000

[54] GAS TURBINE COMBUSTOR

[75] Inventors: Shigemi Mandai; Masataka Ota; Satoshi Tanimura; Hideki Haruta, all of Takasago, Japan

[73] Assignee: Mitsubishi Heavy Industries, Ltd., Tokyo, Japan

[21] Appl. No.: 09/140,011

[22] Filed: Aug. 26, 1998

[30] Foreign Application Priority Data

Aug. 29, 1997 [JP] Japan ..... 9-234062

[51] Int. Cl.[7] ..... F23R 3/54

[52] U.S. Cl. ..... 60/737; 60/760

[58] Field of Search ..... 60/737, 738, 760, 60/747, 748

[56] References Cited

U.S. PATENT DOCUMENTS

| | | | |
|---|---|---|---|
| 2,630,679 | 3/1953 | Sedille | 60/760 |
| 2,885,858 | 5/1959 | Lloyd . | |
| 4,262,482 | 4/1981 | Roffe et al. | 60/738 |
| 4,408,461 | 10/1983 | Brühwiler et al. . | |
| 4,704,869 | 11/1987 | Iizuka et al. . | |

FOREIGN PATENT DOCUMENTS

| | | |
|---|---|---|
| 0 455 487 | 11/1991 | European Pat. Off. . |
| 0 620 402 | 10/1994 | European Pat. Off. . |
| 0 935 097 | 8/1999 | European Pat. Off. . |

*Primary Examiner*—Louis J. Casaregola
*Attorney, Agent, or Firm*—Wenderoth, Lind & Ponack, L.L.P.

[57] ABSTRACT

In gas turbine combustor in which combustion air flows on outer periphery of cylinder body and turns to enter the cylinder body while being mixed with fuel in main burner to form pre-mixture, there is provided upstream of the main burner 101 in the combustor 103 a rectifier 106 or 108 for rectifying the combustion air so as to make flow velocity of the combustion air uniform, thereby shortcomings in the prior art of concentration non-uniformity of the pre-mixture of main fuel and combustion air, high concentration of $NO_x$ generated from the main burner 101 in combustion, etc. are eliminated and larger combustion range to maintain stable combustion is attained.

8 Claims, 2 Drawing Sheets

GAS TURBINE COMBUSTOR

BACKGROUND OF THE INVENTION

1. Field of the Invention

The present invention relates to a combustor of gas turbine for a thermal power plant and the like.

2. Description of the Prior Art

FIG. 2 is an explanatory view of a prior art premixed flame low $NO_x$ type combustor of gas turbine for a thermal power plant and the like. In this figure, the gas turbine combustor has therein a combustor 203 of cylinder body and eight pieces of main burners 201 are disposed in the combustor 203 around central axis thereof. Main fuel supplied from main fuel nozzles and combustion air are mixed to form a pre-mixture, which is burned in the combustor 203 with a pilot of a pilot fuel supplied from a pilot fuel nozzle 202. The combustion air flows on an outer periphery of the combustor 203 and turns 180° at an air inflow portion 205 to enter the combustor 203. In FIG. 2, numeral 204 designates a pilot air swirler, which is disposed for supplying combustion air for burning the pilot fuel.

In the prior art gas turbine combustor as mentioned above, the combustion air flows on the outer periphery of the combustor 203 of cylinder body and then turns 180° at the air inflow portion 205 to enter the combustor 203, hence the combustion air, so turned, is biased to the central portion, so that velocity distribution of the combustion air in the combustor 203 in the cross section A—A of FIG. 2(*a*) tends to become faster at the central portion of the combustor 203 and slower at the peripheral portion of same.

If such biasing occurs in the velocity distribution of the combustion air in the combustor 203, concentration of the premixed fuel of the main fuel and the combustion air becomes non-uniform and there arise shortcomings such that $NO_x$ generating at the main burners 201 in the combustion becomes high in concentration, combustion range for effecting a stable combustion in the combustor 203 becomes narrow, etc.

SUMMARY OF THE INVENTION

In order to dissolve said shortcomings in the prior art gas turbine combustor, it is an object of the present invention to provide a gas turbine combustor in which a combustion air flows on an outer periphery of cylinder body and turns to enter the cylinder body while being mixed with a fuel in a main burner to form a pre-mixture, characterized in that there is provided upstream of said main burner in said cylinder body a rectifier for rectifying the combustion air so as to make uniform a flow velocity of the combustion air in the combustor.

In the gas turbine combustor according to the present invention as mentioned above, there is provided upstream of the main burner the rectifier for rectifying the combustion air flowing on the outer periphery of the cylinder body of the combustor and turning to enter the cylinder body so as to make the flow velocity distribution of the combustion air uniform, thereby the flow rate of the combustion air upstream of the main burner in the cylinder body of the combustor becomes uniform.

Also, the gas turbine combustor according to the present invention is characterized in that there are provided a plurality of said main burners around a central axis of said cylinder body and said rectifier is such one as having an opening formed in a ring shape so as to close a central portion of said cylinder body. According to the present gas turbine combustor, by use of a simple structure of the rectifier, the combustion air is rectified so that biasing of the combustion air toward the central portion of the cylinder body of the combustor is corrected and a rectifying effect for making the flow velocity in the cylinder body uniform is obtained.

Also, the gas turbine combustor according to the present invention is characterized in that there are provided a plurality of said main burners around a central axis of said cylinder body and said rectifier is such one as having a plurality of openings, each formed in a round hole shape corresponding to said plurality of main burners, positioned upstream of said plurality of main burners. According to the present gas turbine combustor, the rectifier for rectifying the combustion air to be led into the main burner has a higher rectifying function so that biasing of the combustion air toward the central portion of the cylinder body of the combustor is corrected and a higher rectifying effect for making the flow velocity in the cylinder body uniform is obtained.

DESCRIPTION OF THE PREFERRED EMBODIMENTS

Figure 1A:
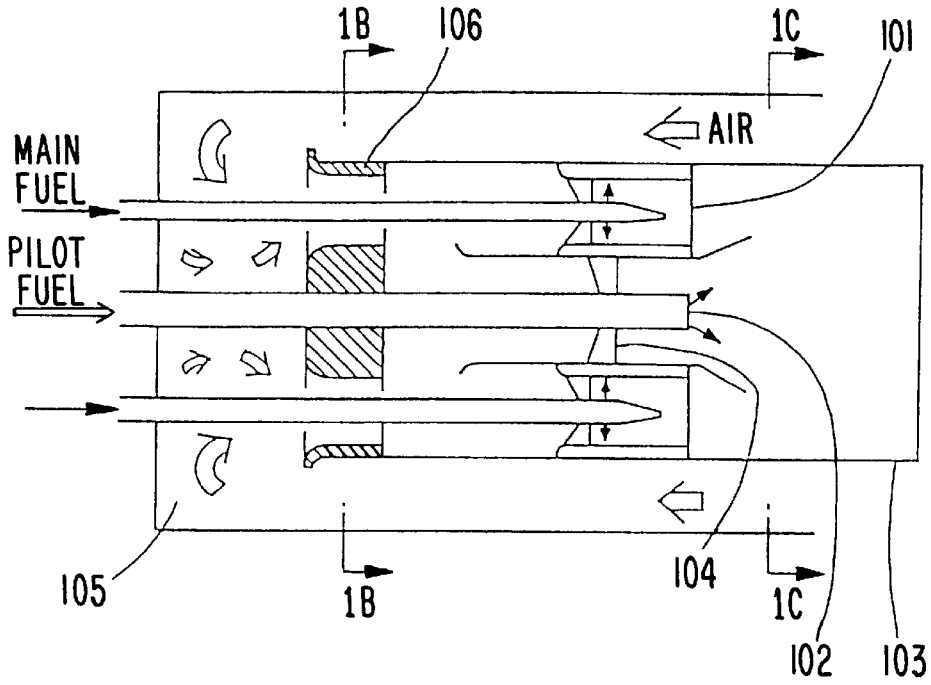
FIG. 1 is an explanatory view of a gas turbine combustor of one embodiment according to the present invention, wherein FIG. 1(*a*) is a longitudinal cross sectional view thereof, FIG. 1 (*b*) is a cross sectional view showing one example of rectifier taken on line B—B of FIG. 1(*a*), FIG. 1(*c*) is an explanatory view showing an effect of the rectifier and FIG. 1(*d*) is a cross sectional view showing another example of rectifier taken on line B—B of FIG. 1(*a*).
Figure 1D:
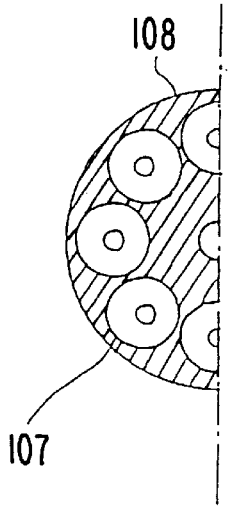
Figure 1B:
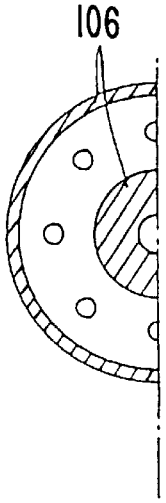
Figure 1C:
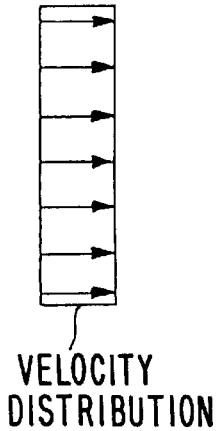
Figure 2A:
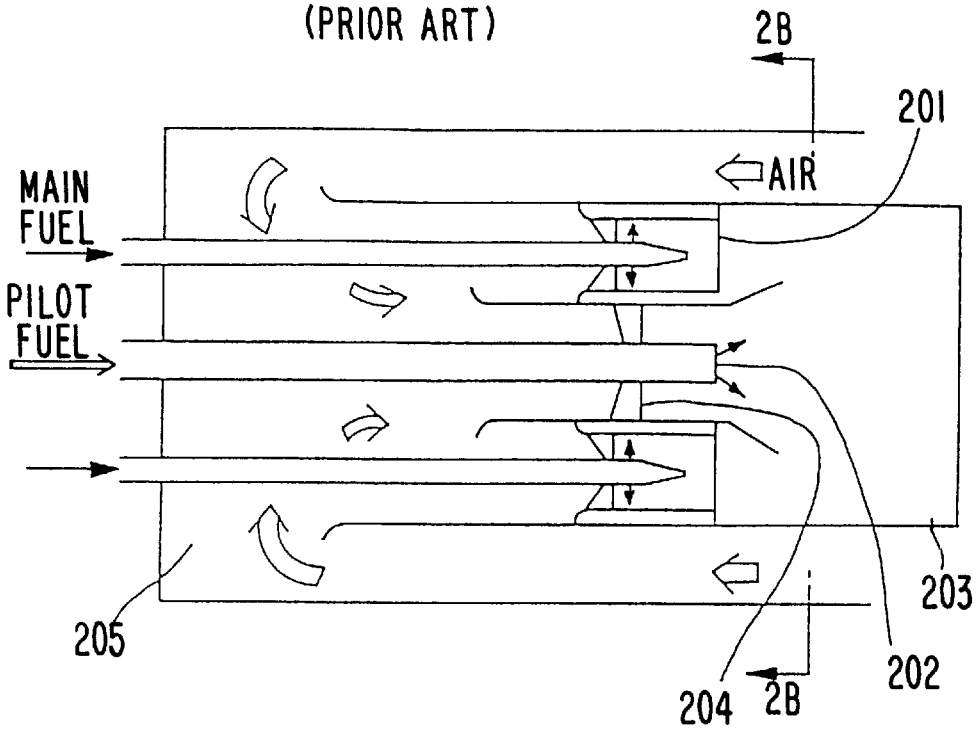
FIG. 2(a) (PRIOR ART)
FIG. 2 is an explanatory view of a prior art gas turbine combustor, wherein FIG. 2(*a*) is a longitudinal cross sectional view thereof, FIG. 2(*b*) is a cross sectional view taken on line A—A of FIG. 2(*a*) and FIG. 2(*c*) is an explanatory view showing an effect thereof.
Figure 2B:
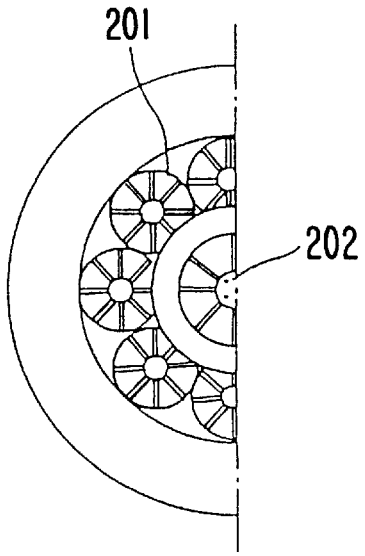
FIG. 2(b) (PRIOR ART)
Figure 2C:
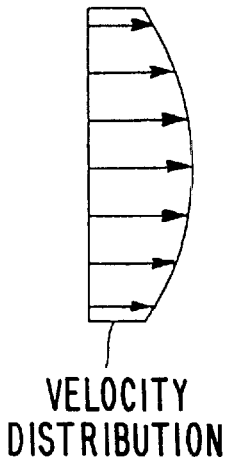
FIG. 2(c) (PRIOR ART)

FIG. 1 is an explanatory view of a premixed flame low $NO_x$ type combustor of gas turbine of one embodiment according to the present invention. In this figure, the gas turbine combustor of the embodiment is a combustor of a gas turbine used for a thermal power plant and the like, and numeral 101 designates a main burner of the gas turbine combustor, numeral 102 designates a pilot fuel nozzle of the gas turbine combustor, numeral 103 designates a combustor of cylinder body, numeral 104 designates a pilot air swirler, which is disposed for supplying a combustion air for burning a pilot fuel, numeral 105 designates an air inflow portion, at which the combustion air, flowing on an outer periphery of the combustor 103, turns 180° to enter the combustor 103 and numeral 106 designates a rectifier, which is disposed at an inlet of the combustor 103 for rectifying the combustion air flowing through the air inflow portion 105 to enter the combustor 103 so that flow velocity of the combustion air in the combustor 103 is made uniform substantially.

In the mentioned gas turbine combustor, eight pieces of the main burners 101 are disposed in the combustor 103 and main fuel supplied from main fuel nozzles and combustion air are mixed to form a pre-mixture, which is burned in the combustion 103 with a pilot of the pilot fuel supplied from the pilot fuel nozzle 102. The combustion air flows on the outer periphery of the combustor 103 and turns 180° at the air inflow portion 105 to enter the combustor 103.

In the present gas turbine combustor, as shown in FIG. 1(*a*), the rectifier 106 is disposed at the inlet of the combustor 103, thereby the combustion air, flowing on the outer periphery of the combustor 103 and turning 180° at the air inflow portion 105 to enter the combustor 103, is rectified, so that the flow velocity of the combustion air in the combustor 103 is made uniform substantially. The rectifier 106, as shown in FIG. 1(*b*), is of a shape having an opening of doughnut-shape so as to close a central portion of the combustor 103, thus the combustion air flowing into the main burners 101 and the pilot air swirler 104, respectively, becomes substantially uniform in the flow rate in the combustor 103, so that the flow velocity of the combustion air becomes nearly equal in the entire area within the combustor 103. It is to be noted that, as shown in FIG. 1(*d*), in place of the rectifier 106 having the doughnut-shape opening, such a rectifier 108 may be provided as having eight pieces of round hole-shape openings 107 to position upstream on central axes of the respective main burners 101. By employing such shape of the rectifier 106 or 108, a rectifier having a less pressure loss and a larger rectifying effect can be obtained.

While the combustion air turns 180° at the air inflow portion 105 to enter the combustor 103, there is provided on the upstream side of the main burners 101 and the pilot air nozzle 102 the rectifier 106 having the doughnut-shape opening or the rectifier 108 having the round hole-shape openings to correspond to the number of respective position of the main burners 101, thereby the combustion air is suppressed to flow at the central portion of the combustor 103 and flows through the opening or openings. Hence, the pressure loss of the combustion air flow at the central portion increases, so that the flow rate of the combustion air flowing into the main burners 101 and that flowing into the pilot air swirler 104 become nearly equal to each other and the flow velocity of the combustion air becomes uniform in the entire area of the combustor 103. thus, the flow rate of the combustion air flowing into the pilot air swirler 104 is reduced and the flow velocity distribution of the combustion air at a cross section C—C of FIG. 1(*a*) in the combustor 103 becomes uniform as shown in FIG. 1(*c*).

While either of said rectifiers is of a simple structure having a high rectifying effect and an optimum rectifying effect can be selected by the size of the opening and the size of the portion closing the central portion of the combustor, the rectifier 108 having the round hole-shape openings to correspond to the number and respective position of the main burners 101 has a higher rectifying effect, as compared with the rectifier 106 having the doughnut-shape opening, in the rectifying effect to induce the combustion air into the main burners 101.

In the prior art gas turbine combustor, because the combustion air, flowing on the outer periphery of the combustor, turns 180° at the air inflow portion and enters the combustor, the flow velocity distribution of the combustion air on the cross section of the combustor tends to become faster at the central portion of the combustor and slower at the peripheral portion. If there occurs such a biasing in the flow velocity distribution of the combustion air in the combustor, concentration of the pre-mixture of the main fuel and the combustion air becomes non-uniform and there arise such shortcomings that concentration of $NO_x$ generating from the main fuel in the combustion becomes higher, the combustion range within which a stable combustion is maintained becomes narrower, etc.

In the gas turbine combustor according to the present invention, on the contrary, there is provided the rectifier 106 or 108 on the upstream side of the main burners 101 and the pilot air nozzle 102, thereby the combustion air flowing on the outer periphery of the combustor 103 and turning 180° at the air inflow portion 105 is rectified before entering the combustor 103, so that the flow velocity distribution of the combustion air in the combustor 103 is made uniform. Thus, the flow rate of the combustion air in the main burners 101 is made uniform and concentration of the pre-mixture of the main fuel and the combustion air becomes uniform. Hence, $NO_x$ amount generated from the main burners 101 in the combustion becomes nearly zero and the combustion range within which a stable combustion is maintained in the combustor 103 becomes enlarged.

It is understood that the invention is not limited to the particular construction and arrangement herein illustrated and described but embraces such modified forms thereof as come within the scope of the following claims.

What is claimed is:

1. A gas turbine combustor comprising:

a cylinder body having an upstream side;

a pilot fuel nozzle disposed along a central axis of said cylinder body;

a pilot swirler disposed around said pilot fuel nozzle;

a plurality of main burners disposed about an outer periphery of said pilot swirler, wherein combustion air flows along an outer periphery of said cylinder body and turns to enter said cylinder body from the upstream side of said cylinder body so as to flow into said pilot fuel nozzle and said main burners, and then the combustion air is to be mixed with a fuel to effect combustion; and an air flow adjusting device disposed on the upstream end of said cylinder body, said air flow adjusting device being capable of adjusting the flow of combustion air such that a flow velocity of the combustion air in said main burners and said air flow adjusting device is made uniform, wherein said air flow adjusting device is adapted to cause a flow rate of the combustion gas flowing into said main burners and a flow rate of the combustion gas flowing into said pilot swirler to become nearly equal.

2. A gas turbine combustor as claimed in claim 1, wherein said air flow adjusting device defines an annular opening so that a central portion of said cylinder body is closed by said air flow adjusting device to prevent combustion air from flowing in the central portion of said cylinder body, and the flow adjusting device permits the combustion air to flow in a peripheral portion of said cylinder body that corresponds to the locations of said main burners.

3. A gas turbine combustor as claimed in claim 1, wherein said air flow adjusting device defines a plurality of openings located in a portion of air flow adjuster that is intermediate a central axis and an outer periphery of said air flow adjusting device, and said openings are aligned with central axes of said main burners, respectively.

4. A gas turbine combustor as claimed in claim 3, wherein each of said openings has a round shape.

5. A gas turbine combustor comprising:

a cylindrical body having a central axis;

a pilot fuel nozzle positioned in said cylindrical body and aligned with the central axis thereof;

a pilot air swirler surrounding said pilot fuel nozzle;

a plurality of axially extending main burners disposed within said cylindrical body and around said pilot air swirler; and an air flow adjuster disposed in an upstream end of said cylinder body, said air flow adjuster being capable of modifying a flow of combustion air turned 180 degrees into the upstream end of said cylinder body such that the flow of combustion air downstream of said air flow adjuster is uniform across the cylinder body and the rate of flow into said pilot fuel nozzle is nearly equal to the rate of flow into said main burners.

6. A gas turbine combustor as claimed in claim 5, wherein said air flow adjuster defines an annular opening and a closed central portion to block the flow of combustion air toward the central axis of said cylinder body.

7. A gas turbine combustor as claimed in claim 5, wherein said air flow adjuster defines a plurality of openings located in an intermediate portion of air flow adjuster, and each of said openings is aligned with a central axis of one of said main burners.

8. A gas turbine combustor as claimed in claim 7, wherein each of said openings has a round shape.

* * * * *